US008807808B2

(12) United States Patent
Boyd, Jr. et al.

(10) Patent No.: US 8,807,808 B2
(45) Date of Patent: Aug. 19, 2014

(54) LED RETROFIT VEHICLE TAIL LAMP

(76) Inventors: Ronald E. Boyd, Jr., Chichester, NH (US); Lawrence M. Rice, Hillsboro, MA (US); Thomas Tessnow, Weare, NH (US)

( * ) Notice: Subject to any disclaimer, the term of this patent is extended or adjusted under 35 U.S.C. 154(b) by 155 days.

(21) Appl. No.: 13/558,544

(22) Filed: Jul. 26, 2012

(65) Prior Publication Data

US 2014/0029283 A1 Jan. 30, 2014

(51) Int. Cl.
*F21V 7/00* (2006.01)

(52) U.S. Cl.
USPC ..... 362/514; 362/507; 362/548; 362/549

(58) Field of Classification Search
USPC ..... 362/507, 514, 516–519, 545, 548–549
See application file for complete search history.

(56) References Cited

U.S. PATENT DOCUMENTS 6,585,395 B2 7/2003 Luk
6,773,138 B2 8/2004 Coushaine
7,110,656 B2 9/2006 Coushaine et al.
7,186,010 B2 3/2007 Coushaine et al.
7,407,304 B2 8/2008 Tasson et al.
7,588,359 B2 9/2009 Coushaine et al.
8,201,980 B2 * 6/2012 Ookubo et al. ..... 362/517
2005/0169006 A1 8/2005 Wang et al.
2005/0281047 A1 12/2005 Coushaine et al.
2010/0207505 A1 8/2010 Tessnow

* cited by examiner

*Primary Examiner* — Jason Moon Han
(74) *Attorney, Agent, or Firm* — Edward S. Podszus

(57) ABSTRACT

A replacement vehicular lamp assembly (10) configured for insertion into a vehicle chassis-mounted lamp housing (110) originally containing an incandescent lamp (118) installed in an aperture (102) in a chassis-mounted reflector (116). Lamp assembly (10) has a housing (12) supporting LED(s) and displaceably mounted reflector segments (40) moveable between a closed configuration facilitating installation through the aperture (102) and an outwardly open configuration for function within the lamp housing (110) to form a first reflector (38). A biasing mechanism (25) biases the reflector segments (40) to the open configuration to deploy the first reflector (38) overlying the chassis-mounted reflector (116) so that light from the LED is received on the first reflector (38) defined by the reflector segments (40).

15 Claims, 4 Drawing Sheets

LED RETROFIT VEHICLE TAIL LAMP

GOVERNMENT CONTRACT

This application is not the result of any government contract and the United States Government has no rights hereunder.

TECHNICAL FIELD

The embodiments herein relate to solid-state retrofit lamps as replacement for incandescent vehicular lights, in particular to taillights or running lights.

BACKGROUND ART

An increasing number of vehicular lights employ solid-state emitters, such, for example, as light emitting diodes (LEDs). These lights are relatively inexpensive, are rugged since they do not use a heated filament, and have very long life. Because of these attributes a sizeable after-market has developed to provide solid-state replacements for previously used incandescent lamps. Some vehicular LED lamps are provided as original equipment requiring that the reflector that is mounted to the vehicle chassis as part of the lampset is matched to the original lamp source, and that the vehicle chassis is designed with a space to accommodate a heat sink. The following are known in the art: U.S. Pat. No. 6,773,138 (Coushaine); U.S. Pat. No. 7,186,010 (Coushaine); U.S. Pat. No. 7,588,359 (Coushaine); and US Published Patent Application 2010/0207505 (Tessnow). An obstacle to market acceptance of energy efficient and long-life LED retrofits as an aftermarket product for conventional factory-installed incandescent lamps such as tail and position lamps is that vehicle running lights and taillights are designed as a two-part unit having a light source, conventionally provided by a heated incandescent filament, and a factory installed reflector. In the United States, for example, the photometric light output for such units is defined by SAE standards as exemplified in 49 CFR Part 571. Legal requirements exist in Europe where standards for stop and position lamps are defined by regulations denominated R007 and direction indicator lamps by R006. The following LED lamps are also known: U.S. Pat. No. 7,407,302 (Tasson); U.S. Pat. No. 6,585,395 (Luk); and US Pub. Pat. Appln. 2005/0169006 (Wang).

Accordingly, it would be an advance to provide a solid-state replacement light source whose light output meets necessary government regulations.

DISCLOSURE OF EMBODIMENTS

An improved solid-state replacement vehicular light source is provided by a lamp assembly adapted for insertion into an existing vehicle chassis-mounted lamp housing originally designed for receiving a specific lamp specified as an OEM (original equipment) lamp and operable with a first reflector, for example, an incandescent lamp, installed into an aperture in a chassis-mounted reflector.

The lamp assembly has a housing, which optionally includes a core projecting therefrom, and a plurality of reflector segments displaceably attached to the core and moveable between a closed configuration for installation through an aperture and an outwardly open configuration for function within the lamp housing to form a second reflector. A biasing mechanism is operative to bias the plurality of reflector segments toward the open configuration. Once through the aperture, the biasing mechanism biases the plurality of reflector segments to the open configuration. A socket is associated with the housing, for connecting the lamp assembly to a power source and at least one solid-state light source is positioned with the replacement vehicle lamp assembly so as to deliver light to the first reflector when the segments are in the open configuration. Suitable electrical connections are provided between the socket and the solid-state light source.

BEST MODE FOR CARRYING OUT THE EMBODIMENTS

For a better understanding of the present embodiments and its advantages, reference is made to the following disclosure and appended claims taken in conjunction with the above-described drawings.

Figure 1:
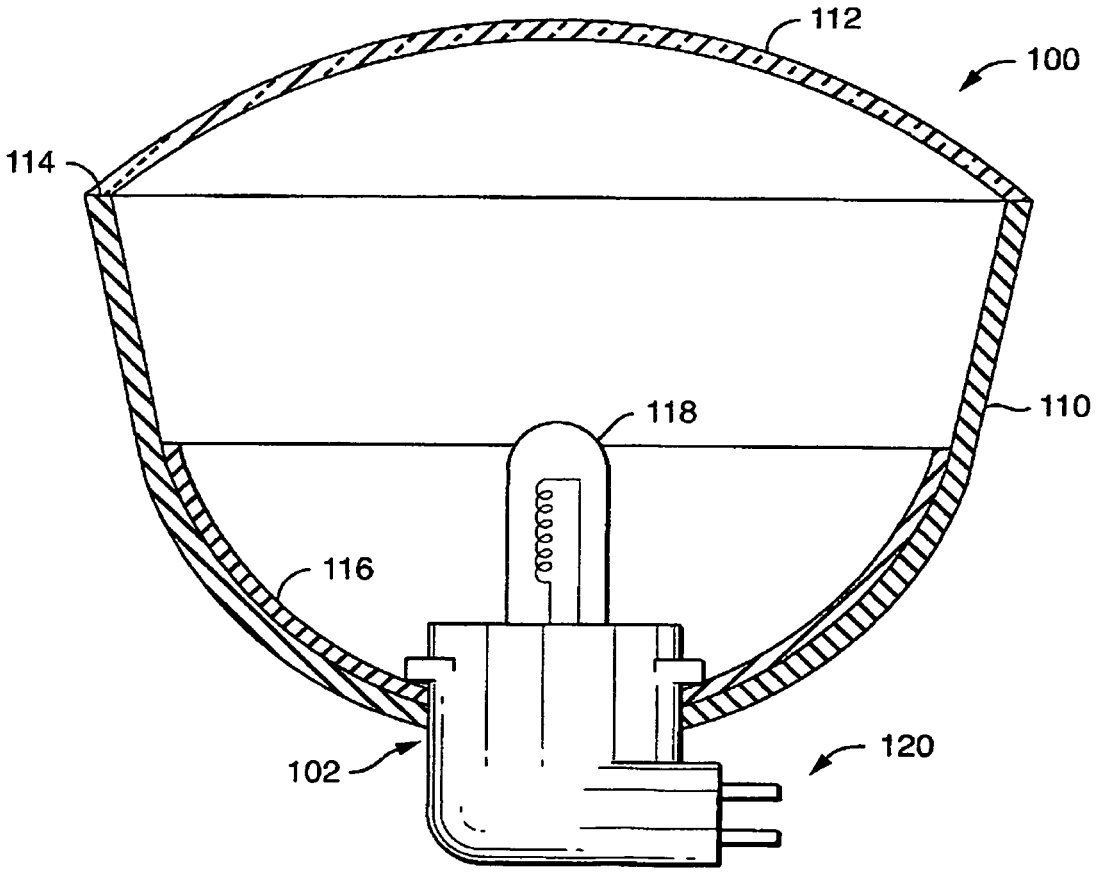
FIG. 1 PRIOR ART
FIG. 1 is an elevation view, partially in section, of a prior art embodiment.

FIG. 1 shows a general prior art vehicle chassis-mounted lampset 100 having housing 110 formed to receive a particular light source, for example, incandescent bulb 118. Light source 118 is installed into aperture 102 in a chassis-mounted reflector 116, with light source 118, lens 112 and the chassis-mounted reflector 116 having been designed as an original equipment manufactured ("OEM") unit to provide a light output in accordance with applicable governmental regulations.

Figure 2:
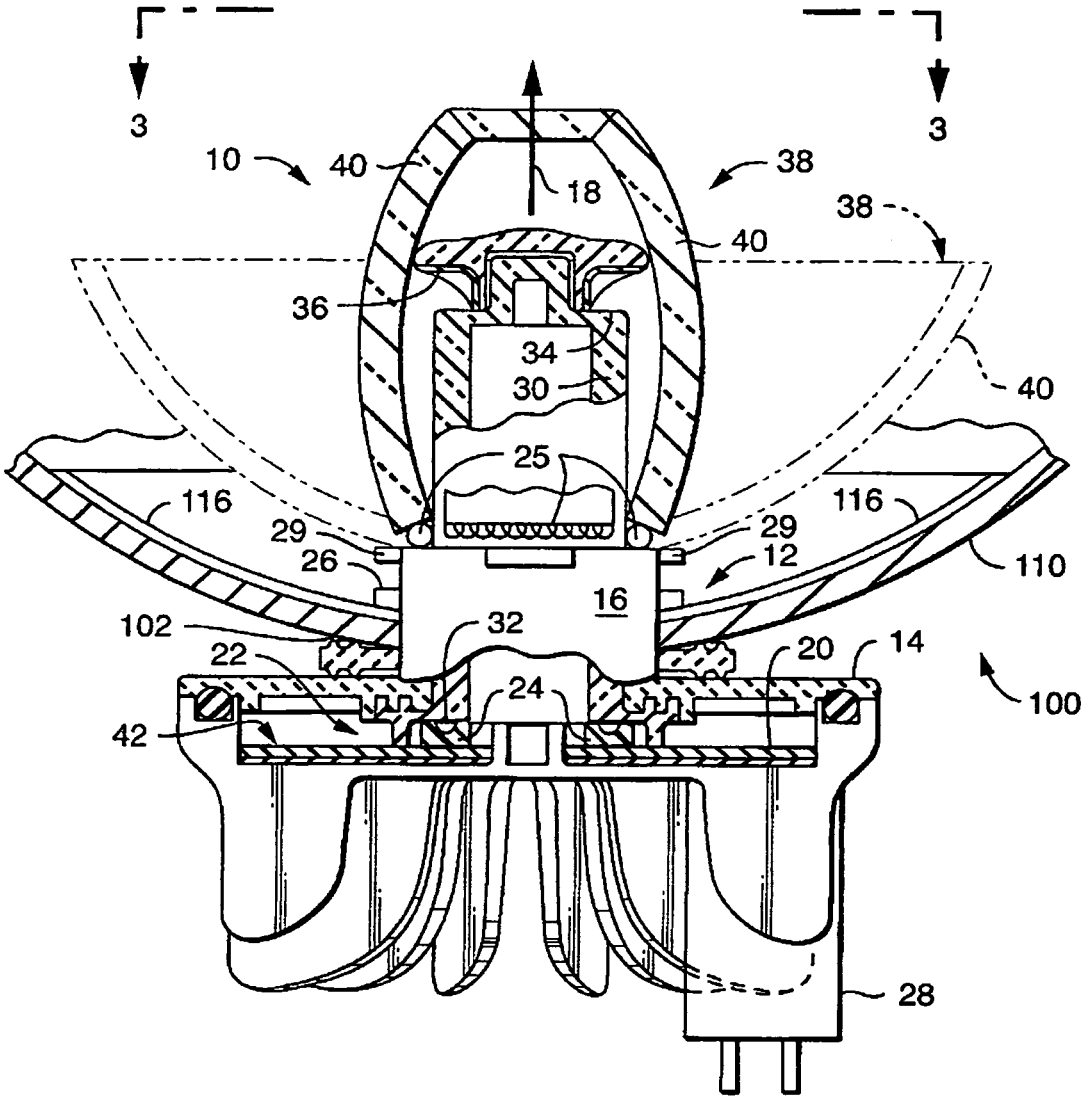
FIG. 2 is an elevation view, partially in section, of a first embodiment of a replacement solid-state light source.

FIG. 2 shows a replacement lamp assembly 10 comprises a housing 12 having, optionally, a core 16 projecting therefrom. Reflector segments 40 are displaceably attached to the housing 12, for example, to the core 16 and are moveable between a closed configuration for installation through the aperture 102 and an outwardly open configuration for function within the lamp housing 110 to form a first reflector 38. In a preferred embodiment the reflector segments 40 are pivoted. Reflector segments 38 can be rigid. The outward movement of the reflector segments 40 is preferably restricted by a plurality of deployment stops 29 affixed to the core 16. The number of deployment stops 29 can be equal in number to the number of reflector segments 40. In FIG. 2 the reflector segments 40 are shown in the closed configuration by solid lines and by phantom lines in the open configuration.

A biasing mechanism 25, which can be in the form of a spring or coiled spring, is operative to bias the reflector segments 40 toward the open configuration.

A socket 28 is associated with the housing 12, the socket 28 connecting the lamp assembly 10 to a power source (not shown).

At least one solid-state light source 24, for example, at least one light emitting diode (LED or array of LEDs) is positioned with the vehicle lamp assembly 10 so as to deliver light to the first reflector 38 when the reflector segments 40 are in the open configuration. Electrical connections 42, preferably in the form of a printed circuit board, extend between the socket 28 and the solid-state light source 24.

Figure 3:
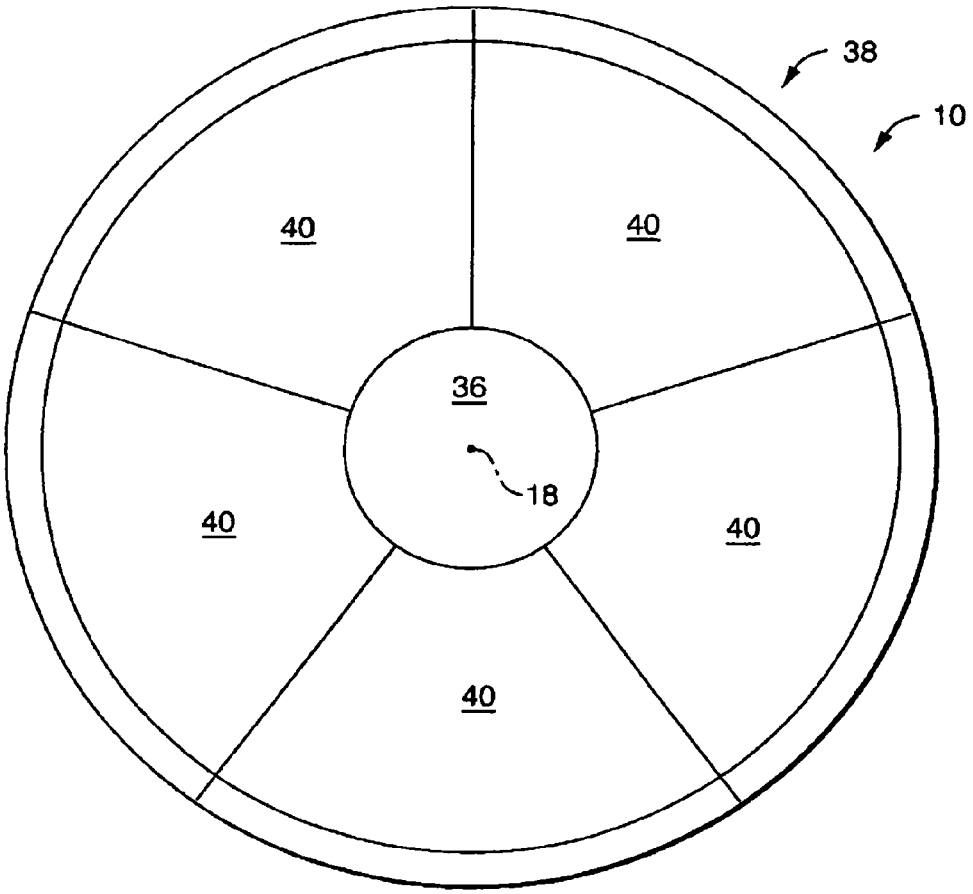
FIG. 3 is a plan view taken along the line 3-3 of FIG. 2.

Preferably the reflector segments 40 each comprises a section of a parabola, a complete parabola being formed when the reflector segments 40 are in the open position. In a preferred embodiment there are five segments 40 which, when positioned in the open configuration, present a first reflector 38 substantially encompassing 360 degrees deployed about a longitudinal axis 18, see FIG. 3.

As generally understood by one of ordinary skill in the art, the surface of the first reflector 38 may include parametric and/or nonparametric surface definition types including, but not limited to, non-uniform rational basis spline (NURBS) curves and/or surfaces configured to reflect the light received from the solid state-light source 24 in the desired pattern.

Commercially available software, including but not limited to, computer-aided design (CAD), computer-aided manufacturing (CAM), and computer-aided engineering (CAE) software, may be used for the design of NURBS curves and/or surfaces of the first reflector 38. For example, a reflector 38 consistent with the present disclosure may be designed using LucidShape computer-aided lighting software offered by Brandenburg GmbH (Paderborn, Germany).

Replacement vehicle lamp 10 is capable of many embodiments. For example, in the embodiment shown in FIG. 2, light sources 24 are mounted upon a printed circuit board 42 set in a base 14 of the housing 12 and the light from the sources 24 is directed to a second reflector 36 via a light guide 30 and then to the first reflector 38 for emission to the outside of the vehicle. The light guide 30 is positioned in the core 16 and has a first end 32 in operative relationship with the light sources 24. A second end 34 of the light guide 30 projects beyond the core 16 to a position adjacent the second reflector 36.

Figure 4:
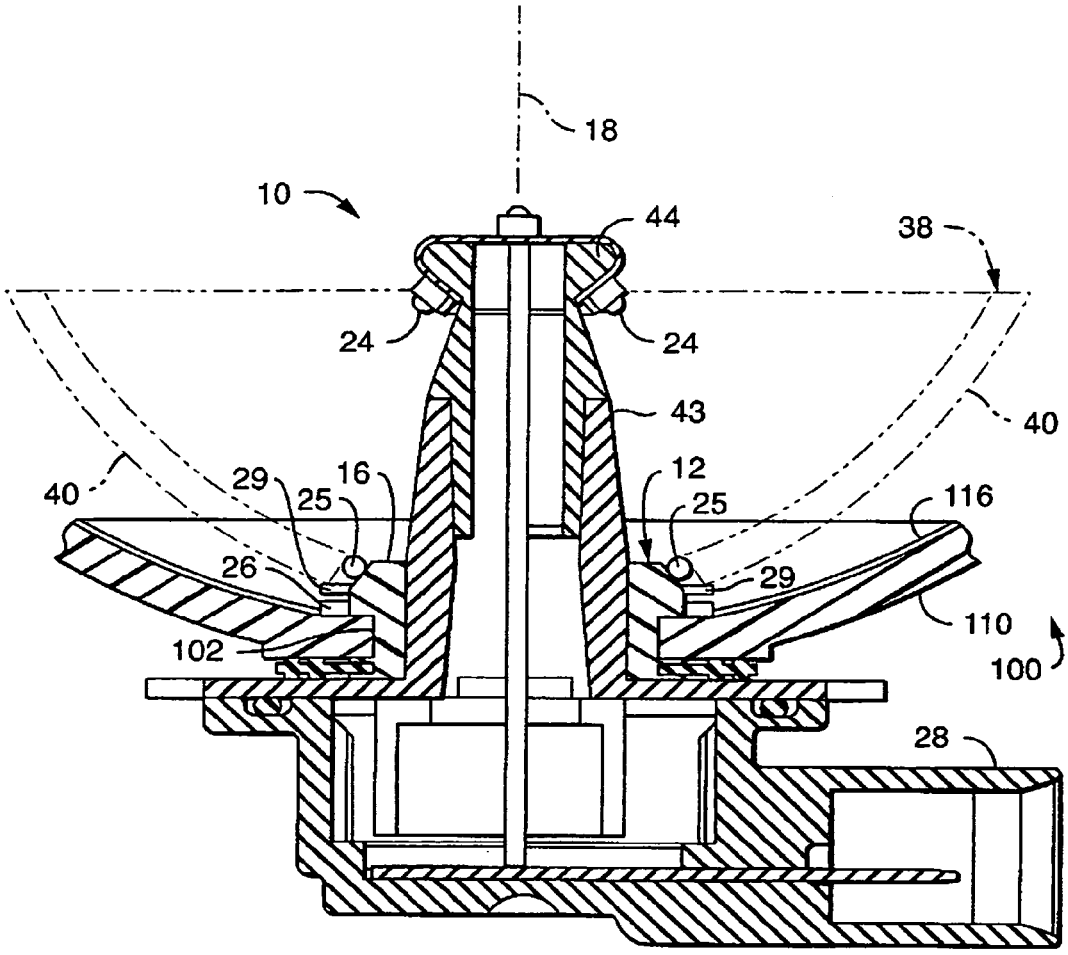
FIG. 4 is an elevation view, partially in section, of a second embodiment of a replacement solid-state light source.

In the embodiment shown in FIG. 4, a body 43 projects from the core 16 and terminates in a cap 44, the underside of which carries a plurality of light sources 24. In this case the light emitted by the light sources 24 is directed directly toward the first reflector 38.

In using replacement vehicle lamp 10 to provide a given light output from a lampset 100 the existing first light source 118 is removed, and replaced by the replacement vehicle lamp 10. Replacement is accomplished by compressing the reflector segments 40 against either the body 43 (as shown in FIG. 4) or the light guide 30 (as shown in FIG. 2) and inserting the lamp 10 into the housing 110 via the aperture 102. Upon insertion reflector segments 40 are moved to the open configuration. Biasing mechanism 25 can bias reflector segments 40 open or even deploy the segments 40 to the open configuration. Lamp assembly 10 is locked in position by a twisting motion to engage locking lugs 26 with the body 110 of lampset 100, as is conventional.

Thus, there is provided a replacement vehicle lamp 10 that provides its own reflector 38 which will be designed to match the solid-state source 24 regardless of the factory-installed lampset reflector 116 in order that the aftermarket lamp meets applicable regulations on light output to make driving safer.

While there have been shown and described what are at present considered to be the preferred embodiments it will be apparent to those skilled in the art that various changes and modifications can be made herein without departing from the scope of the embodiments as defined by the appended claims.

For purposes of this application it is to be understood that when an element or layer is referred to as being "on," "connected to" or "coupled to" another element or layer, it can be directly on, connected to or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. The term "and/or" includes any and all combinations of one or more of the associated listed items.

Although the terms "first," "second," "third" etc. may be used to describe various elements, components, regions, layers and/or sections, these elements, components, regions, layers and/or sections are not to be limited by theses terms as they are used only to distinguish one element, component, region, layer or section from another element, component, region, layer or section. Thus, a first element, component, region, layer or section could be termed a second element, component, region, layer or section without departing from the scope and teachings of the present embodiments.

Spatially relative terms, such as "beneath," below," upper," "lower," "above" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting. For example, as used herein, the singular forms "a," "an" and "the" are intended to include the plural forms as well, unless the context clearly indicates otherwise. It will be further understood that the terms, "comprises" and/or "comprising," when used in this specification, specify the presence of stated features, integers, steps operations, elements, and/or components, but do not preclude the presence or addition of one or more other features, integers, steps, operations, elements, components, and/or groups thereof.

GLOSSARY OF REFERENCE NUMBERS USED HEREIN

10 Lamp assembly
12 Housing
14 Base of housing 12
16 Hollow core
18 Longitudinal axis
20 Printed circuit board
22 End of core
24 LEDs
25 Biasing mechanism
26 Positioning lugs
28 Socket for lamp assembly
29 Deployment stops
30 Light guide
32 First end of light guide
34 Second end of light guide
36 Second reflector
38 First reflector
40 Reflector segment
42 Electrical connections
43 Body
44 Cap
100 Lampset
102 Aperture in lampset
110 Lamp housing of lampset
112 Lens of lampset
114 End of body
116 Lampset reflector
118 First light source
120 Lampset 100 socket

What is claimed is:

1. A vehicular lamp assembly (10) adapted for insertion into a vehicle chassis-mounted lamp housing (110) receiving an incandescent lamp (118) installed into an aperture (102) in a chassis-mounted reflector (116), said lamp assembly (10) comprising:

a housing (12);

at least one solid-state light source (24) disposed within said housing (12) to emit light;

a plurality of reflector segments (40) displaceably attached to said housing (12) and moveable between a closed configuration facilitating installation through said aperture (102) and an open configuration for operative association within the chassis-mounted lamp housing (110) to collectively define a first reflector (38), wherein in said open configuration said first reflector (38) receives light emitted by said solid-state light source (24);

a biasing member (25) adapted to bias said plurality of reflector segments (40) toward said open configuration, said biasing member (25) comprising a spring;

an electrical socket (28) in operative association with said housing (12), said socket (28) adapted to connect the lamp assembly (10) to a power source; and electrical connections (42) between said socket (28) and said solid-state light source (24); and wherein said plurality of reflector segments (40) are movable to the closed configuration to pass through said aperture (102), and once through, said biasing member (25) biases said plurality of reflector segments (40) to the open configuration.

2. The vehicular lamp assembly (10) of claim 1 wherein said reflector segments (40) are pivotally attached to said housing (12).

3. The vehicular lamp assembly (10) of claim 1 wherein outward displacement of said reflector segments (40) to said open configuration is limited by a plurality of deployment stops (29) defined on said housing (12).

4. The vehicular lamp assembly (10) of claim 3 wherein each of the plurality of said deployment stops (29) is associated with a respective one of said plurality of reflector segments (40).

5. The vehicular lamp assembly (10) of claim 1 wherein said at least one solid-state light source (24) is a light emitting diode.

6. The vehicular lamp assembly (10) of claim 1 wherein said at least one solid-state light source (24) is mounted to emit light directly at said plurality of reflector segments (40).

7. The vehicular lamp assembly (10) of claim 1 wherein said at least one solid-state light source (24) is mounted to emit light to at least one primary optical member selected from the group of a light guide (30), an optic, and a second reflector (36), and an output of said primary optical member being directed to said plurality of reflector segments (40).

8. The vehicular lamp assembly (10) of claim 7 wherein said at least one solid-state light source (24) directs light to said first reflector (38) via a light guide (30) whose output is coupled to a second reflector (36).

9. The vehicular lamp assembly (10) of claim 8 wherein said housing (12) defines a core (16), said light guide (30) is positioned in said core (16), said light guide (30) having a first end (32) optically coupled to said at least one solid-state light source (24) and a second end (34) projecting beyond said core (16) and optically coupled to said second reflector (36), wherein light from said at least one solid-state light source (24) is reflectively directed to said plurality of reflector segments (40).

10. The vehicular lamp assembly (10) of claim 1 wherein each of said plurality of reflector segments (40) comprises a section of a parabola.

11. The vehicular lamp assembly (10) of claim 1 wherein the number of said reflector segments (40) is five.

12. The vehicular lamp assembly (10) of claim 1, wherein said housing (12) defines a longitudinal axis (18) extending through a central portion of said lamp assembly (10); and wherein said plurality of reflector segments (40) when deployed in said open configuration extends substantially circumferentially around said longitudinal axis (18).

13. The vehicular lamp assembly (10) of claim 1 wherein the plurality of reflector segments (40) are rigid.

14. A method of replacing an incandescent lamp (118) disposed in an aperture (102) of a lamp housing (110) of a vehicular lampset (100) disposed in a vehicle chassis, said lamp housing (110) further containing a light output lens (112) and a chassis-mounted lamp reflector (116) arranged to receive light from said incandescent lamp (118) and direct light towards said light output lens (112), comprising:

removing said incandescent lamp (118) from said aperture (102) of said lamp housing (110);

providing a solid-state lamp (10) having a solid-state light source (24) and a first reflector (38);

inserting said solid-state lamp (10) into said aperture (102) of said lamp housing (110);

positioning via a spring said first reflector (38) of said solid-state lamp (10) within said lamp housing (110); and occluding said chassis-mounted lamp reflector (116) with said first reflector (38), whereby light emitted from said solid-state light source (24) is received on said first reflector (38) and directed to said light output lens (112).

15. The method of claim 14, wherein said positioning step further comprises deploying a plurality of reflector segments (40) attached to said solid-state lamp (10), said deployed reflector segments (40) defining said first reflector (38); and said occluding step further comprises said deployed reflector segments (40) covering substantially all of said chassis-mounted lamp reflector (116).

* * * * *